US007446476B2

(12) United States Patent
Kwon et al.

(10) Patent No.: US 7,446,476 B2
(45) Date of Patent: Nov. 4, 2008

(54) PLASMA DISPLAY PANEL

(75) Inventors: Jae-Ik Kwon, Asan-si (KR); Seo-Young Choi, Yongin-si (KR); Hun-Suk Yoo, Cheonan-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 208 days.

(21) Appl. No.: 11/089,154

(22) Filed: Mar. 25, 2005

(65) Prior Publication Data

US 2005/0213010 A1 Sep. 29, 2005

(30) Foreign Application Priority Data

Mar. 26, 2004 (KR) ..... 10-2004-0020766

(51) Int. Cl.
*H01J 17/16* (2006.01)
*H01J 17/49* (2006.01)

(52) U.S. Cl. ..... 313/586; 313/587; 313/582

(58) Field of Classification Search ..... 313/582, 313/586, 587

See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,744,909 | A * | 4/1998 | Amano | 313/585 |
| 5,786,794 | A | 7/1998 | Kishi et al. | |
| 5,952,782 | A | 9/1999 | Nanto et al. | |
| RE37,444 | E | 11/2001 | Kanazawa | |
| 6,630,916 | B1 | 10/2003 | Shinoda | |
| 6,707,436 | B2 | 3/2004 | Setoguchi et al. | |

FOREIGN PATENT DOCUMENTS

EP 1122759 A2 * 8/2001

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Nimeshkumar Patel
*Assistant Examiner*—Anthony T Perry
(74) *Attorney, Agent, or Firm*—Robert E. Bushnell, Esq.

(57) ABSTRACT

A plasma display panel includes a substrate which includes first and second substrates disposed facing each other, a plurality of discharge electrodes disposed along a circumference of a discharge cell formed between the first and second substrates, a dielectric wall which buries the discharge electrodes, and a secondary electron emission amplifying unit which emits the secondary electrons into the discharge space and which is formed on at least a portion of a surface which contacts plasma generated in the discharge space during a discharge. The discharge voltage can be reduced due to an increase in the emission of the secondary electrons.

29 Claims, 5 Drawing Sheets

FOREIGN PATENT DOCUMENTS

| | | |
|---|---|---|
| JP | 02-148645 | 6/1990 |
| JP | 2845183 | 10/1998 |
| JP | 2917279 | 4/1999 |
| JP | 2001-043804 | 2/2001 |
| JP | 2001-325888 | 11/2001 |
| KR | 100196408 | 2/1999 |
| KR | 10-2002-0036888 | 5/2002 |

OTHER PUBLICATIONS

U.S. Appl. No. —to be assigned—to Jae-Ik Kwon, entitled *Plasma Display Panel*, which is concurrently filed with this application.

Korean Office Action of the Korean Patent Application No. 2004-20766, issued on Apr. 26, 2006.

* cited by examiner

PLASMA DISPLAY PANEL

CROSS REFERENCE TO RELATED APPLICATION

This application relates to a U.S. patent application which is concurrently submitted to the U.S. Patent & Trademark Office with this application, and which is based upon a Korean Priority Serial No. 2004-24892 entitled PLASMA DISPLAY PANEL filed in the Korean Intellectual Property Office on 12 Apr. 2004. The related application is incorporated herein by reference in its entirety.

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 26 Mar. 2004 and there duly assigned Ser. No. 2004-20766.

BACKGROUND OF THE INVENTION

1. Field of the Invention

The present invention relates to a plasma display panel, and more particularly, to a plasma display panel having an improved structure that can increase the emission of secondary electrons.

2. Description of the Related Art

Plasma display devices are flat panel display devices that display a desired number, a letter, or a graphic on a surface facing a plurality of substrates. A plurality of discharge electrodes are formed on a discharge surface, and a discharge space is filled with a discharge gas and sealed. The discharge gas generates light in the discharge space when a discharge voltage is applied to the discharge electrodes. Then, an image can be displayed on the discharge surface by applying an appropriate pulse voltage to points where the discharge electrodes are crossing.

Plasma display panels can be divided into a direct current type and an alternating current type according to the types of the driving voltage applied to the discharge cell or into a facing discharge type and a surface discharge type according to the configuration of the electrodes.

A surface discharge type plasma display panel includes a front substrate, a discharge sustaining electrode pair that includes X and Y electrodes disposed on an inner surface of the front substrate, a front dielectric layer that covers the discharge sustaining electrode pair, a protective layer coated on a surface of the front dielectric layer, a rear substrate disposed facing the front substrate, address electrodes disposed on an inner side of the rear substrate, a rear dielectric layer that covers the address electrodes, a plurality of barrier ribs disposed on the rear dielectric layer, fluorescent layers of red, green, and blue colors coated on inner walls of the barrier ribs. A space formed by coupling the front substrate and the rear substrate is filled with an inert discharge gas.

In the plasma display panel described above, when an electrical signal is applied between the address electrode and the Y electrode, a discharge cell for light emitting is selected, and when an electric signal is alternately applied to the X and Y electrodes, a stationary or a moving image can be displayed by emitting visible light from the fluorescent layer coated in the selected discharge cell.

In a three-electrode surface discharge type plasma display panel, brightness of the panel is displayed by ultraviolet rays and visible light generated by the discharge through the transparent discharge sustaining electrode pair, the front dielectric layer, and the protective layer. Therefore, the electrodes must be designed in consideration of an opening ratio in the fabricating of panels, and an appropriate material for forming the front dielectric layer and the protective layer must be selected.

The protective layer prevents the front dielectric layer from colliding with ions and reduces a discharge voltage by emitting secondary electrons when the ions collide with the front dielectric layer.

However, a conventional protective layer leads to an increase in voltage and a reduction in brightness since the protective layer is formed of magnesium oxide having a low secondary electron emission coefficient. Therefore, a protective layer that can emit a large amount of secondary electrons in the discharge space and is sufficiently resistant to sputtering is needed.

Also, the opening ratio of the panel must be considered when the protective layer is formed of a material having a high secondary electron emission coefficient since the conventional plasma display panel is disposed on an inner side of the front substrate.

SUMMARY OF THE INVENTION

It is therefore an object of the present invention to provide a plasma display panel having an improved structure in which a protective layer having a high secondary electron emission coefficient is formed along a circumference of a discharge cell.

It is another object of the present invention to provide a plasma display panel having an improved structure that can emit secondary electrons on all surfaces contacting plasma.

According to an aspect of the present invention, there is provided a PDP including: a substrate that includes first and second substrates disposed facing each other; a plurality of discharge electrodes disposed along a circumference of a discharge cell formed between the first and second substrates; a dielectric wall that buries the discharge electrodes; and a secondary electron emission amplifying unit which emits the secondary electrons into the discharge space, and which is formed on at least a portion of a surface that contacts plasma generated during discharging.

The secondary electron emission amplifying unit may be a single protective layer formed of CNT (carbon nanotube).

The secondary electron emission amplifying unit may be a multi-layer that includes a first protective layer formed of CNT and a second protective layer, which is an oxide layer, formed on the first protective layer.

The second protective layer may be a material layer selected from the group consisting of MgO layer, $Al_2O_3$ layer, ZnO layer, CaO layer, SrO layer, $SiO_2$ layer, and $La_2O_3$ layer.

The secondary electron emission amplifying unit may be a multi-layer that includes a first protective layer formed of CNT and a second protective layer, which is a fluoride layer, formed on the first protective layer.

The second protective layer may be a material layer selected from the group consisting of $MgF_2$ layer, $CaF_2$ layer, and LiF layer.

The secondary electron emission amplifying unit can be at least a single protective layer selected from one of an oxide layer and a fluoride layer.

The secondary electron emission amplifying unit can be a protective layer formed by selectively combining an oxide layer, a fluoride layer, and CNTs.

The secondary electron emission amplifying unit may be formed on a surface of the. dielectric wall.

The secondary electron emission amplifying unit may be formed on an inner surface of the first and second substrates disposed facing each other.

The secondary electron emission amplifying unit may be formed on a surface of the fluorescent layer.

The secondary electron emission amplifying unit may be formed on at least two surfaces selected from the surface of the dielectric wall, the inner surface of the first and second substrates disposed facing each other, and the surface of the fluorescent layer.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

The present invention will now be described more fully with reference to the accompanying drawings in which exemplary embodiments of the invention are shown.

Figure 1:
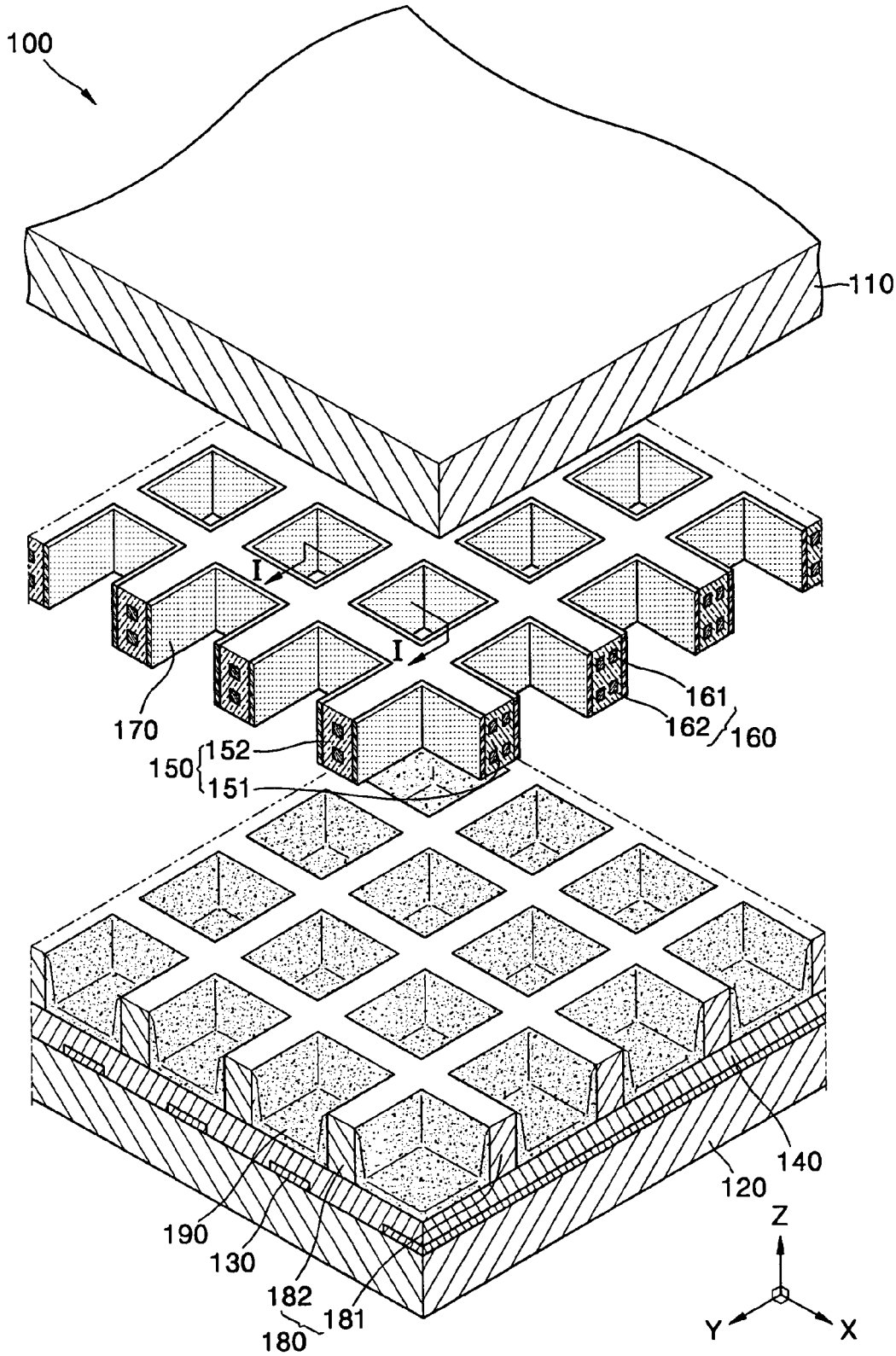
FIG. 1 is an exploded perspective partial cutaway view illustrating a plasma display panel according to a first embodiment of the present invention.
Figure 2:
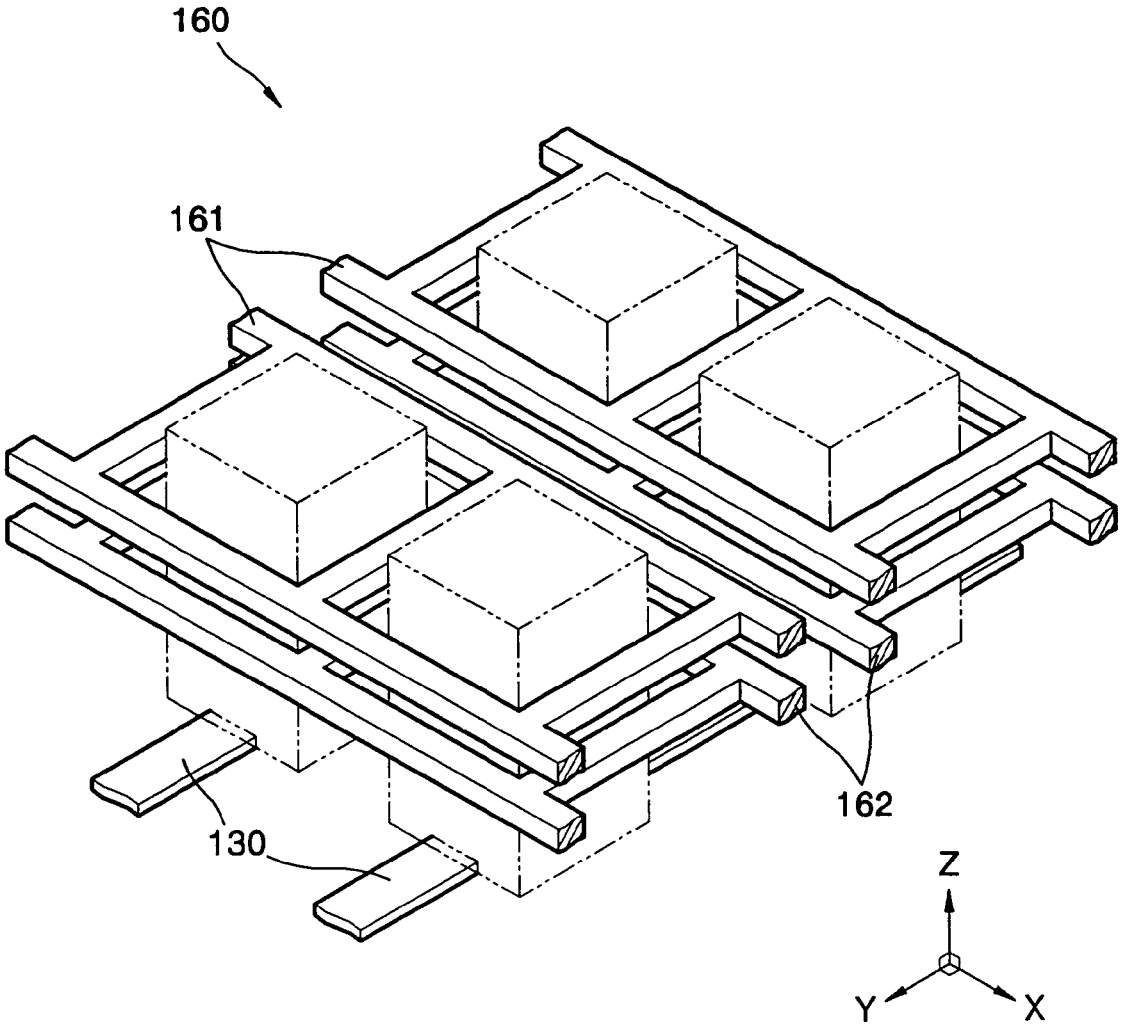
FIG. 2 is a perspective view of discharge electrodes of FIG. 1.

FIG. 1 is an exploded perspective partial cutaway view illustrating a plasma display panel 100 according to a first embodiment of the present invention. FIG. 2 is a perspective view of discharge electrodes of FIG. 1, and FIG. 3 is a cross-sectional view taken along line I-I of FIG. 1.

Figure 3:
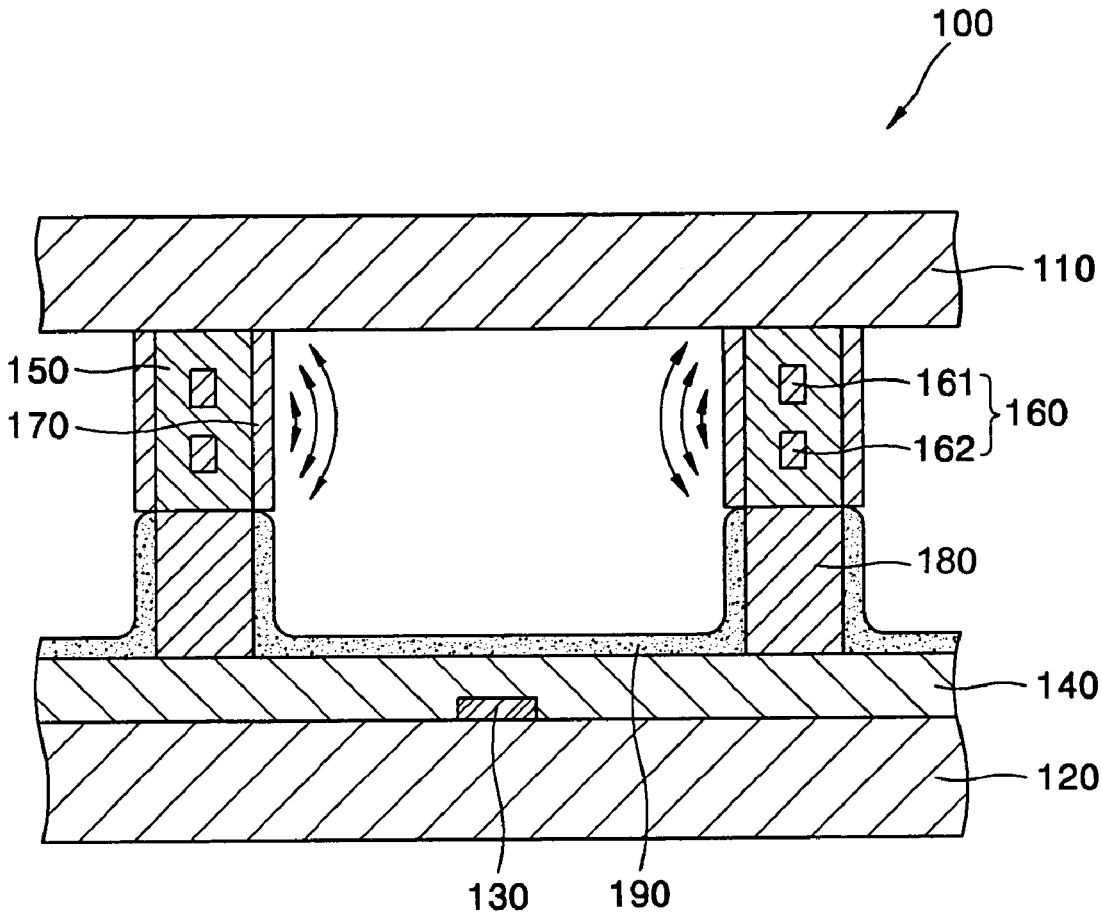
FIG. 3 is a cross-sectional view taken along line I-I of FIG. 1.

Referring to FIGS. 1 through 3, the plasma display panel 100 includes a front substrate 110 and a rear substrate 120 disposed parallel to the front substrate 110. The front substrate 110 and the rear substrate 120 form a closed discharge space by coating frit glass along inner edges of the facing surface.

The front substrate 110 is a transparent substrate formed of soda lime glass.

The rear substrate 120 is formed of substantially the same material as the front substrate 110. Address electrodes 130 are disposed on an inner surface of the rear substrate 120. The address electrodes 130 are formed in a plurality of strips and disposed along the Y direction of the rear substrate 120. The address electrodes 130 are extended crossing the discharge cells in the Y direction of the rear substrate 120, and formed of a metal having high conductivity, such as Ag paste.

The address electrodes 130 are buried by a dielectric layer 140. The dielectric layer 140 is formed of a transparent high dielectric, such as $PbO—B_2O_3—SiO_2$ and is coated on an entire upper surface of the rear substrate 120 to bury the address electrodes 130. Alternately, the dielectric layer 140 can be coated selectively only on the portions where the address electrodes 130 are formed to bury the address electrodes 130.

A dielectric wall 150 that defines the discharge cells together with the front and rear substrates 110 and 120 is interposed between the front substrate 110 and the rear substrate 120. The dielectric wall 150 is formed of glass paste to which various fillers are added. The dielectric wall 150 includes a first dielectric wall 151 disposed in a perpendicular direction (X direction) to the address electrode 130 and a second dielectric wall 152 disposed in a Y direction parallel to the address electrodes 130. The first dielectric wall 151 defines a discharge space in a matrix shape by extending one body in a facing direction toward an inner wall of a pair of the second dielectric wall 152.

Alternately, the dielectric wall 150 can be formed in various shapes such as a meander shape, a delta shape, or a stripe shape. Also, the discharge cell defined by the dielectric wall 150 can have any shape, such as a polygon, a circle, or an oval.

A discharge sustaining electrode pair 160 is disposed in the dielectric layer 140. The discharge sustaining electrode pair 160 includes an X electrode 161 disposed relatively close to the front substrate 110 and a Y electrode 162 disposed relatively close to the rear substrate 120. The Y electrode 162 is disposed separately under the X electrode 161. The X electrode 161 and the Y electrode 162 are electrically insulated and a different voltage from each other can be applied.

The X electrode 161 and the Y electrode 162 are disposed along the circumference of the discharge cell. That is, the X electrode 161 is disposed along the X direction of the plasma display panel 100. The X electrode 161 is located along a circumference of the discharge cell defined by the dielectric wall 150 and each discharge cell is formed in a rectangular shape.

Also, the X electrode 161 is disposed consecutively along a circumference of the discharge cell formed adjacent in an X direction of the plasma display panel 100. Therefore, the X electrode 161 is formed in a ladder shape along X direction of the plasma display panel 100. A plurality of the ladder-shaped structures is disposed apart a predetermined distance along the Y direction of the plasma display panel 100.

The Y electrode 162 is separately disposed under the X electrode 161 along a circumference of the discharge cell like the X electrode 161. Also, the Y electrode 162 has a ladder shape and is disposed along a circumference of the discharge cell formed adjacent in the X direction of the plasma display panel 100. The X and Y electrodes 161 and 162 have substantially the same shape except that they are connected to external terminals from different sides of the plasma display panel 100.

A protective layer 170 is formed on an inner surface of the dielectric wall 150. The protective layer 170 is formed of a material such as magnesium oxide (MgO) to emit secondary electrons to the discharge space by a reaction between the surface of the dielectric wall 150 and ions generated on inner sides of the plasma display panel 100 along four side walls of the discharge cell.

That is, a discharge sustaining electrode pair, a dielectric layer that buries the discharge sustaining electrode pair, and a protective layer coated on an surface of the dielectric layer are not formed on an inner surface of the front substrate 110. Accordingly, an opening ratio with respect to the front substrate 110 can be improved.

A barrier rib 180 can further be disposed between the dielectric wall 150 and the rear substrate 120. The barrier rib 180 is formed of a low dielectric material unlike the dielectric wall 150. The barrier rib 180 is formed substantially in the same shape as the dielectric wall 150 on a portion corresponding to the dielectric wall 150.

The barrier rib 180 includes a first barrier rib 181 disposed in a direction (X direction) perpendicular to the address electrodes 130 and a second barrier rib 182 disposed in a direction (Y direction) parallel to the address electrodes 130. The first and second barrier ribs 181 and 182 are combined in a single body and form a matrix shape.

A single wall defines the discharge cell when only the dielectric wall 150 is disposed between the front and rear substrate 110 and 120, and a double wall defines the discharge cell when both the dielectric wall 150 and the barrier rib 180 are disposed between the front and rear substrate 110 and 120.

A mixed gas, such as He—Xe is filled in the discharge space defined by the front and rear substrate 110 and 120, the dielectric wall 150, and the barrier rib 180.

Also, fluorescent layers 190 of red, green, and blue colors that emit visible light by being excited by ultra violet rays generated from the discharge gas are coated on the walls of the discharge space. The fluorescent layer 190 can be coated on any surface of the discharge space, but it is preferable to form the fluorescent layer 190 to be lower than the height of the barrier rib 180 in consideration of the transmittance of visible light.

In the discharge space described above, light emission efficiency can be significantly increased since a low voltage driving is possible although high concentration of a discharge gas, for example, 10 vol. % Xe gas, is used because the discharge region can be extended to four surfaces of the discharge space and, as a result, the amount of plasma is increased.

Here, the protective layer 170 is preferably formed of a secondary electron emission amplifying unit having a high secondary electron emission coefficient, such as carbon nano tube (CNT).

CNT has the maximum current conveying capacity of $1\times10^{19}$ A/cm$^2$, which is superior to that of copper or aluminum, and has superior tensile strength, temperature stability, and heat transfer characteristic than copper or aluminum. The protective layer 170 formed of CNT can emit a large amount of electrons because it has a quantum behavior characteristic without resistance to electrons being transferred and generates no heat.

The protective layer 170 formed of CNT can be formed using a CNT raw material by various methods, such as plasma enhanced chemical vapor deposition (PECVD), thermal chemical vapor deposition, laser deposition, an electric discharge, electrolysis, vapor synthesis, or flame synthesis.

Figure 4:
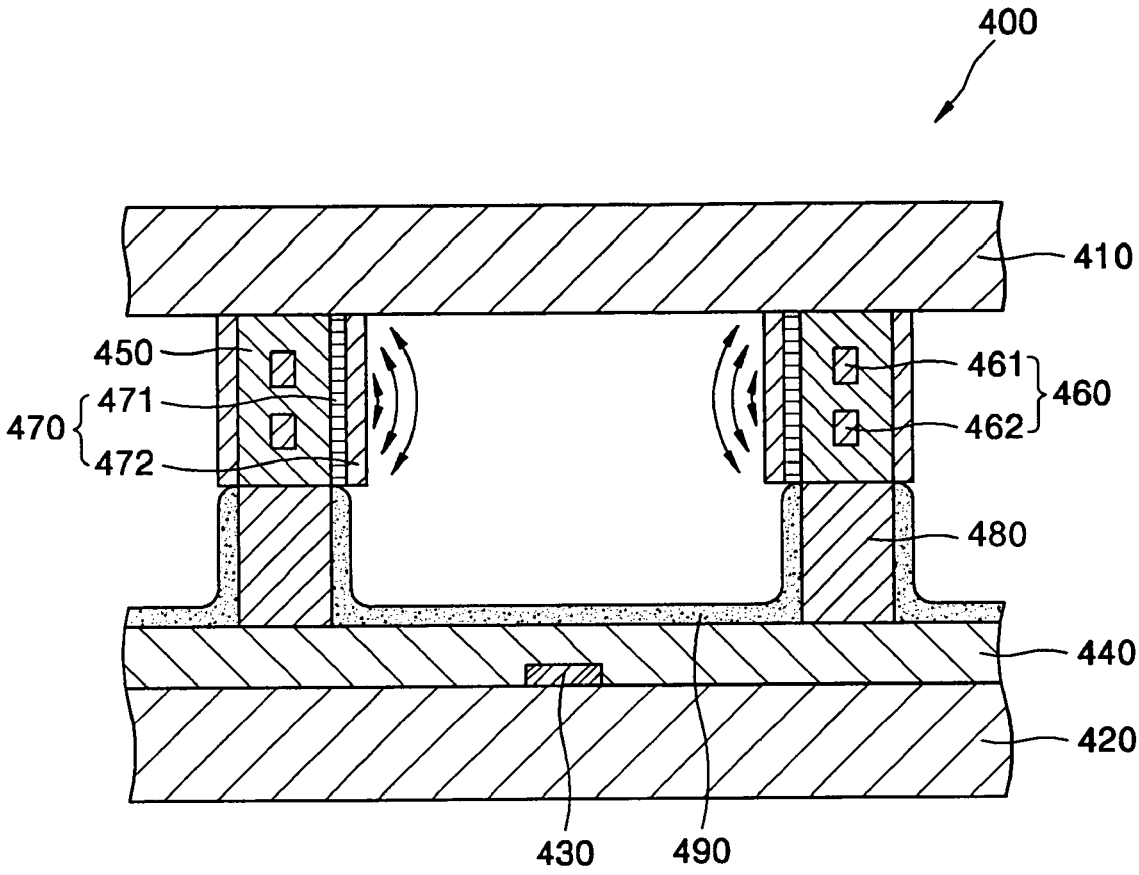
FIG. 4 is a cross-sectional view illustrating a unit discharge of a plasma display panel according to a second embodiment of the present invention.

FIG. 4 is a cross-sectional view illustrating a unit discharge of a plasma display panel according to a second embodiment of the present invention.

As depicted in FIG. 4, a protective layer 470 can be a secondary electron emission amplifying unit formed of a multiple layer including CNT. That is, a front substrate 410 and a rear substrate 420 facing the front substrate 410, an address electrode 430 on an upper surface of the rear substrate 420, and a dielectric layer 440 buried in the address electrode 430 are included in a plasma display panel 400.

Also, barrier ribs 480 are disposed between the front substrate 410 and the rear substrate 420, and fluorescent layers 490 of red, green, and blue colors are coated on walls of a discharge space defined by the barrier ribs 480.

A discharge sustaining electrode pair 460 is disposed between the front substrate 410 and the barrier ribs 480 along a circumference of the discharge cell. The discharge sustaining electrode pair 460 includes an X electrode 461 disposed close to the front substrate 410 and a Y electrode 462 disposed separately under the X electrode 461 and close to the address electrodes 430. The discharge sustaining electrode pair 460 that includes the X electrode 461 and the Y electrode 462 is buried by the dielectric wall 450 having a high dielectric constant.

A protective layer 470 for protecting the insulation breakage of the dielectric wall 450 and for emitting secondary electrons is formed on an inner surface of the dielectric wall 450. At this time, the protective layer 470 includes a first protective layer 471 and a second protective layer 472 coated on an upper surface of the first protective layer 471.

The first protective layer 471 is a means for amplifying the emission of secondary electrons and is formed of a material having a high secondary electron emission coefficient such as CNT.

The second protective layer 472 is an oxide layer or a fluoride layer. When it is an oxide layer, the second protective layer 472 can be formed of a material selected from the group consisting of MgO, $Al_2O_3$, ZnO, CaO, SrO, $SiO_2$, and $La_2O_3$, and when it is a fluoride layer, it can be formed of a material selected from the group consisting of $MgF_2$, $CaF_2$, and LiF.

Accordingly, when a voltage greater than the discharge breakdown voltage is applied between the X and Y electrodes 461 and 462, a large amount of secondary electrons are emitted by a surface discharge in the discharge space. This means that a facing plasma discharge state is formed in a discharge space by applying a voltage between the X and Y electrodes 461 and 462. Also, it means that more of the discharge gas filled in the discharge space ionizes at the same voltage than in the prior art.

Figure 5:
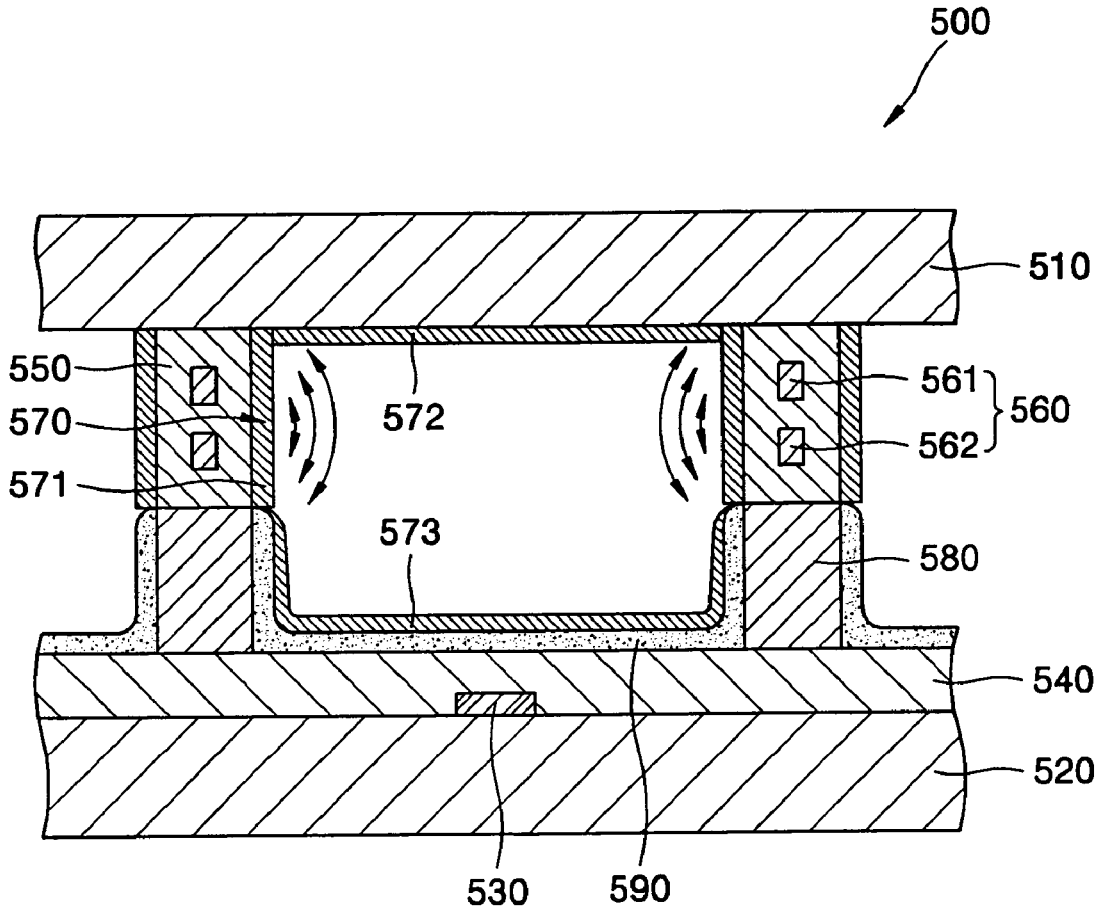
FIG. 5 is a cross-sectional view illustrating a unit discharge of a plasma display panel according to a third embodiment of the present invention.

FIG. 5 is a cross-sectional view illustrating a unit discharge of a plasma display panel according to a third embodiment of the present invention. Referring to FIG. 5, a plasma display panel 500 includes a front substrate 510 and a rear substrate 520 facing the front substrate 510. An address electrode 530 in a stripe shape is formed on an upper surface of the rear substrate 520, and the address electrode 530 is buried by a dielectric layer 540. Barrier ribs 580 are disposed between the front substrate 510 and the rear substrate 520, and fluorescent layers 590 of red, green, and blue colors are coated on walls of a discharge space defined by the barrier ribs 580.

A discharge sustaining electrode pair 560 is formed between upper parts of the front substrate 510 and the barrier ribs 580 and is disposed along a circumference of the discharge cell. The discharge sustaining electrode pair 560 includes an X electrode 561 and a Y electrode 562, and the X electrode 561 and the Y electrode 562 are separated in a vertical direction.

The discharge sustaining electrode pair 560 is buried by the dielectric wall 550. At this time, a protective layer 570 is formed on a surface that can contact plasma so that the emission amount of the secondary electrons can increase when a voltage greater than the discharge firing voltage is applied between the X and Y electrodes 561 and 562.

That is, a first protective layer 571 is coated on a surface of the dielectric wall 550. A second protective layer 572 is deposited on an inner surface of the front substrate 510 disposed on the discharge space. Also, a third protective layer 573 is formed on an upper surface of the fluorescent layer 590 coated in the discharge space defined by the barrier ribs 580.

At this time, the protective layer 570 can be a single layer or multiple layers mixed with the single layers to increase the emission of secondary electrons. That is, the first protective layer 571 formed on a surface of the dielectric wall 550 can be a single layer formed of CNT or a stacked layer in which an oxide layer or a fluoride layer is stacked on the CNT layer.

However, the second and third protective layers 572 and 573 formed on the front and rear substrates 510 and 520, and disposed in the discharge space, can be an oxide layer that includes MgO or a fluoride layer that includes $MgF_2$.

Alternately, the first through third protective layers 571, 572, and 573 can be substantially the same material layer, such as an oxide layer or a fluoride layer. When the first through third protective layers 571, 572, and 573 are an oxide layer, they can be a material layer selected from the group consisting of MgO layer, $Al_2O_3$ layer, ZnO layer, CaO layer, SrO layer, $SiO_2$ layer, and $La_2O_3$ layer, and when the first through third protective layers 571, 572, and 573 are a fluoride layer, they can be a material layer selected from the group consisting of $MgF_2$ layer, $CaF_2$ layer, and LiF layer.

The operation of the plasma display panel 100 having the above structure will now be described with reference to FIG. 3. When a predetermined address voltage is applied between the address electrode 130 and the Y electrode 162 from an external power source, a discharge cell that will generate light is selected. Wall charges are accumulated on the Y electrode 162 of the selected discharge cell.

Next, when a positive voltage is applied to the X electrode 161 and a relatively higher voltage than the positive voltage applied to the X electrode 161 is applied to the Y electrode 162, the accumulated wall charges are migrated by a voltage difference between the X and Y electrodes 161 and 162.

Then, discharges occur by colliding the migrated wall charges with the atoms of the discharge gas filled in the discharge space. As a result, plasma is generated. The discharges may begin at regions close to the X and Y electrodes 161 and 162 since a relatively high electric field is formed close to the X and Y electrodes 161 and 162.

As time passes, when the voltage difference between the X and Y electrodes 161 and 162 is maintained, the discharge diffuses into the whole discharge space since the electric field formed between the X and Y electrodes 161 and 162 becomes stronger.

The discharge in the present embodiment begins at regions close to the four side walls of the discharge space and diffuses into the central portion of the discharge space. Therefore, the discharging area is wide. Accordingly, a large amount of visible light is generated and a low voltage driving is possible since the plasma is concentrated on the central part of the discharge space, which enables the utilization of space charges.

Moreover, ion sputtering to the fluorescent layer 190 can be prevented since the plasma and the wall charges are concentrated on the central part of the discharge space and the electric field is generated, starting from both sides of the plasma, by the X and Y electrodes 161 and 162.

When the voltage difference between the X and Y electrodes 161 and 162 is reduced as the result of the discharge, a further discharge does not occur, and then, space charges and wall charges are formed in the discharge space. At this time, when the polarity of the X and Y electrodes 161 and 162 is reversed, a discharge occurs again with the aid of the wall charges. In this manner, if the polarity of the X and Y electrodes 161 and 162 is reversed repeatedly, stable discharge takes place repeatedly.

A large plasma discharge state can be induced in the discharge space due to the increased amount of secondary electrons by forming a protective layer 170 on a surface of the dielectric wall 150 using CNT having a high secondary electron emission coefficient.

As described above, the plasma display panel according to the present invention has the following advantages since the plasma display panel has a secondary electron emission amplifying unit.

First, the discharge voltage can be reduced due to the increase in the amount of the secondary electrons.

Second, the opening ratio of the substrate can be improved since the secondary electrons are emitted along a circumference of the discharge cell.

Third, the lifetime of the plasma display panel can be extended since the secondary electron emission means is mounted on a contact surface with the plasma.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A plasma display panel, comprising:

a first substrate and a second substrate disposed facing each other;

a plurality of discharge electrodes spaced apart along side portions of a discharge cell formed between said first and second substrates;

dielectric walls forming said side portions of said discharge cell and burying said plurality of discharge electrodes;

secondary electron emission amplifying units emitting secondary electrons into the discharge cell, and being disposed on inner surfaces of said side portions of said discharge cell and contacting plasma generated in the discharge cell during a discharge; and a fluorescent layer disposed on an inner surface of one of the first and second substrates;

wherein an inner surface of another of the first and second substrates is not covered and is directly exposed to the discharge cell, whereby said another of the first and second substrates transmits visible light and an opening ratio of said another of the first and second substrates is improved.

2. The plasma display panel of claim 1, wherein said secondary electron emission amplifying units comprise a single protective layer formed of carbon nanotubes.

3. The plasma display panel of claim 1, wherein said secondary electron emission amplifying units comprise a multilayer including a first protective layer formed of carbon nanotubes, and a second protective layer comprising an oxide layer formed on said first protective layer.

4. The plasma display panel of claim 3, wherein said second protective layer is a material layer selected from the group consisting of MgO layer, $Al_2O_3$ layer, ZnO layer, CaO layer, SrO layer, $SiO_2$ layer, and $La_2O_3$ layer.

5. The plasma display panel of claim 1, wherein said secondary electron emission amplifying units comprise a multilayer including a first protective layer formed of carbon nanotubes, and a second protective layer comprising a fluoride layer formed on said first protective layer.

6. The plasma display panel of claim 5, wherein said second protective layer is a material layer selected from the group consisting of $MgF_2$ layer, $CaF_2$ layer, and LiF layer.

7. The plasma display panel of claim 1, wherein said secondary electron emission amplifying units comprise at least a single protective layer including one of an oxide layer and a fluoride layer.

8. The plasma display panel of claim 1, wherein said secondary electron emission amplifying units comprise a protective layer formed by selectively combining an oxide layer, a fluoride layer, and carbon nanotubes.

9. The plasma display panel of claim 1, wherein said secondary electron emission amplifying units are also disposed on the inner surface of said one of the first and second substrates.

10. The plasma display panel of claim 1, wherein said secondary electron emission amplifying units are also disposed on an inner surface of the fluorescent layer.

11. The plasma display panel of claim 1, wherein said secondary electron emission amplifying units are also disposed on an inner surface of said one of the first and second substrates and a surface of the fluorescent layer.

12. The plasma display panel of claim 1, wherein said plurality of discharge electrodes comprises a discharge sustaining electrode pair including X and Y electrodes, and an address electrode mounted perpendicular to the discharge sustaining electrode pair on said one of the first and second substrates.

13. The plasma display panel of claim 12, wherein said X electrode is disposed in at least one of said dielectric walls adjacent to said first substrate and said Y electrode is disposed in said at least one of said dielectric walls adjacent to said second substrate, and said X and Y electrodes are disposed apart from each other.

14. The plasma display panel of claim 12, wherein each of said X and Y electrodes is consecutively disposed along a periphery of the discharge cell formed adjacent in a direction of said first substrate and said second substrate.

15. The plasma display panel of claim 1, further comprising barrier ribs having a shape corresponding to a shape of each said dielectric wall, and disposed between said each dielectric wall and a corresponding one of said first substrate and said second substrate, and a fluorescent layer coated on inner surfaces of said barrier ribs.

16. The plasma display panel of claim 1, said plurality of discharge electrodes being disposed along a horizontal X-Y plane and being spaced apart along a vertical Z direction approximately perpendicular to the horizontal X-Y plane.

17. A plasma display panel, comprising:

a first substrate;

a second substrate facing said first substrate;

a dielectric wall forming a matrix framework between said first and second substrates and defining a discharge space with said first and second substrates;

a plurality of discharge electrodes embedded within said dielectric wall and spaced apart along a perimeter of the discharge space, said plurality of discharge electrodes being formed between said first and second substrates and being spaced apart vertically along a Z axis when the matrix framework of the dielectric wall and said first and second substrates are arranged along a horizontal X-Y plane, said first and second substrates facing each other in a direction of the Z axis;

an amplifying unit for emitting secondary electrons into the discharge space, and being disposed on an inner side surface of said dielectric wall defining a side portion of the discharge space adjacent to plasma generated in the discharge space during a discharge; and a fluorescent layer disposed on an inner surface of one of the first and second substrates;

wherein an inner surface of another of the first and second substrates is not covered and is directly exposed to the discharge space, whereby said another of the first and second substrates transmits visible light and an opening ratio of said another of the first and second substrates is improved.

18. The plasma display panel of claim 17, said amplifying unit comprising a protective layer formed by selectively combining an oxide layer, a fluoride layer, and carbon nanotubes.

19. The plasma display panel of claim 17, said amplifying unit comprising a plurality of layers including carbon nanotubes.

20. The plasma display panel of claim 17, wherein said plurality of discharge electrodes comprises a discharge sustaining electrode pair including X and Y electrodes, said X electrode being disposed in said dielectric wall adjacent to said first substrate and said Y electrode being disposed in said dielectric wall adjacent to said second substrate, said X and Y electrodes being disposed apart from each other, each of said X and Y electrodes being consecutively disposed along the perimeter of the discharge space formed adjacent in a direction of said first and second substrates.

21. The plasma display panel of claim 17, said amplifying unit comprising a plurality of layers including at least first and second layers, said first layer being formed on the inner side surface of the dielectric wall defining the side portion of the discharge space, said second layer being coated on an inner surface of said first layer.

22. The plasma display panel of claim 21, said first layer being formed of a material having a secondary electron emission coefficient higher than a secondary electron emission coefficient of said second layer.

23. The plasma display panel of claim 21, said second layer comprising one of an oxide layer and a fluoride layer, and said first layer comprising carbon nanotubes.

24. The plasma display panel of claim 17, said amplifying unit comprising a first protective layer, a second protective layer and a third protective layer, said first protective layer being formed on the inner surface of said dielectric wall, said second protective layer being deposited on the inner surface of said one of the first and second substrates defining a rear substrate disposed on the discharge space, said third protective layer being formed on an upper surface of the fluorescent layer, said another of the first and second substrates defining a front substrate, said discharge space being defined by barrier ribs, each one of the three protective layers being one of a single layer and a plurality of layers.

25. A plasma display panel, comprising:

a first substrate and a second substrate disposed facing each other;

a dielectric lattice disposed between said first and second substrates and defining a periphery of a discharge chamber with said first and second substrates;

a plurality of discharge electrodes forming ladder-shaped structures embedded within said dielectric lattice and spaced apart in a certain direction along a boundary of the discharge chamber, said plurality of discharge electrodes being formed between said first and second substrates;

a secondary electron emission amplifying unit for emitting secondary electrons into the discharge chamber, and being disposed on an inner surface of said dielectric lattice defining a side portion of the discharge chamber for contacting plasma generated in the discharge chamber during a discharge; and a fluorescent layer disposed on an inner surface of one of the first and second substrates;

wherein an inner surface of another of the first and second substrates is not covered and is directly exposed to the discharge chamber, whereby said another of the first and second substrates transmits visible light and an opening ratio of said another of the first and second substrates is improved.

26. The plasma display panel of claim 25, said secondary electron emission amplifying unit comprising a protective layer formed by selectively combining a plurality of layers and carbon nanotubes, said carbon nanotubes having a secondary electron emission coefficient higher than a secondary electron emission coefficient of said plurality of layers.

27. The plasma display panel of claim 25, said secondary electron emission amplifying unit comprising a first layer of carbon nanotubes disposed directly on the inner surface of said dielectric lattice and a second layer comprising one of an oxide and a fluoride disposed on the first layer.

28. The plasma display panel of claim 25, wherein said secondary electron emission amplifying unit is also disposed on the inner surface of said one of the first and second substrates.

29. The plasma display panel of claim 25, wherein said secondary electron emission amplifying unit is also disposed on the inner surface of said one of the first and second substrates and a surface of the fluorescent layer.

* * * * *